US011291341B1

(12) United States Patent
McCue et al.

(10) Patent No.: US 11,291,341 B1
(45) Date of Patent: Apr. 5, 2022

(54) TEMPERATURE BASED VACUUM CLEANER FULL BAG INDICATION

(71) Applicant: Emerson Electric Co., St. Louis, MO (US)

(72) Inventors: Thomas L. McCue, Florissant, MO (US); Jason Hill, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 33 days.

(21) Appl. No.: 16/948,820

(22) Filed: Oct. 1, 2020

(51) Int. Cl.

| | |
|---|---|
| ***A47L 9/28*** | (2006.01) |
| ***A47L 9/19*** | (2006.01) |
| ***A47L 9/30*** | (2006.01) |
| *A47L 9/14* | (2006.01) |

(52) U.S. Cl.
CPC ..... *A47L 9/2831* (2013.01); *A47L 9/19* (2013.01); *A47L 9/2889* (2013.01); *A47L 9/30* (2013.01); *A47L 9/14* (2013.01)

(58) Field of Classification Search
CPC .... A47L 9/2805; A47L 9/2831; A47L 9/2836; A47L 9/19; A47L 9/2889; A47L 9/30; A47L 9/14; H02P 29/60; H02P 29/64; H02P 29/67; H02P 29/0241; H02P 8/34; H02P 8/36
USPC ..... 15/319, 339, 344, 347, 412; 318/471–473
See application file for complete search history.

(56) References Cited

U.S. PATENT DOCUMENTS

| | | | | |
|---|---|---|---|---|
| 2,625,239 | A | 1/1953 | Senne | |
| 3,695,006 | A | 10/1972 | Bruno et al. | |
| 6,026,539 | A | 2/2000 | Mouw et al. | |
| 7,640,621 | B2 | 1/2010 | Cloud, III et al. | |
| 8,099,825 | B2 * | 1/2012 | Zahuranec | A47L 9/2842 15/319 |
| 9,074,622 | B2 | 7/2015 | Morgan et al. | |
| 10,646,091 | B2 | 5/2020 | Schnittman et al. | |
| 10,742,094 | B1 * | 8/2020 | Wright | H02K 11/25 |
| 2014/0265978 | A1 * | 9/2014 | Oakley | H02P 29/0241 318/473 |
| 2016/0134225 | A1 * | 5/2016 | Ikitake | H02P 7/05 318/473 |

FOREIGN PATENT DOCUMENTS

| | | | |
|---|---|---|---|
| GB | 1238309 | A | 7/1971 |

* cited by examiner

*Primary Examiner* — Joseph J Hail
*Assistant Examiner* — Robert C Moore
(74) *Attorney, Agent, or Firm* — Armstrong Teasdale LLP

(57) ABSTRACT

A vacuum cleaner includes a housing, a debris chamber defined within the housing, a filter disposed within the debris chamber, a motor assembly including a motor and an impeller connected to the housing and operable to generate airflow through the debris chamber and filter, a voltage sensor positioned to detect an input voltage applied to the motor, a temperature sensor positioned to detect a temperature associated with the motor and a controller communicatively coupled to the voltage sensor, temperature sensor, and motor. The controller includes a processor and memory having instructions that program the processor to determine a threshold temperature based at least in part on the input voltage detected by the voltage sensor, compare the temperature associated with the motor to the threshold temperature, and output a warning that the filter is full of debris when the temperature associated with the motor exceeds the threshold temperature.

20 Claims, 4 Drawing Sheets

TEMPERATURE BASED VACUUM CLEANER FULL BAG INDICATION

FIELD

The field of the disclosure relates generally to vacuum cleaners and, more particularly, to vacuum cleaner motor assemblies and methods of operating same.

BACKGROUND

Vacuum cleaner debris bins or filter bag conditions are important to users. As the vacuum sucks up debris over time, airflow into the motor becomes restricted. At least some known vacuum cleaners use pressure sensors to monitor the airflow to determine the fullness of the debris bag. Such pressure sensor based systems increase the cost of the vacuum cleaners and may allow the temperature of the vacuum motor to increase excessively when the bag is approaching a full condition.

SUMMARY

One aspect of the disclosure is a vacuum cleaner includes a housing, a debris chamber defined within the housing, a filter disposed within the debris chamber, a motor assembly including a motor and an impeller connected to the housing and operable to generate airflow through the debris chamber and filter, a voltage sensor positioned to detect an input voltage applied to the motor, a temperature sensor positioned to detect a temperature associated with the motor and a controller communicatively coupled to the voltage sensor, temperature sensor, and motor. The controller includes a processor and memory having instructions that program the processor to determine a threshold temperature based at least in part on the input voltage detected by the voltage sensor, compare the temperature associated with the motor to the threshold temperature, and output a warning that the filter is full of debris when the temperature associated with the motor exceeds the threshold temperature.

Another aspect of the disclosure is a method of operating a vacuum cleaner including a debris chamber, a filter disposed within the debris chamber, a motor driving an impeller to generate airflow through the debris chamber and the filter, a voltage sensor, a temperature sensor, and a controller communicatively coupled to the voltage sensor, the temperature sensor, and the motor. The method includes determining a threshold temperature based at least in part on an input voltage coupled to the motor and detected by the voltage sensor, comparing a temperature associated with the motor and detected by the temperature sensor to the threshold temperature, and outputting a warning that the filter is full of debris when the temperature associated with the motor exceeds the threshold temperature.

Yet another aspect of the disclosure is a controller for a vacuum cleaner including a housing, a debris chamber defined within the housing, a filter disposed within the debris chamber, a motor driving an impeller to generate airflow through the debris chamber and the filter, a voltage sensor positioned to detect an input voltage applied to the motor, and a temperature sensor positioned to detect a temperature associated with the motor. The controller includes a processor to be communicatively coupled to the motor, the voltage sensor, and the temperature sensor, and a memory. The memory includes instructions that program the processor to determine a threshold temperature based at least in part on the input voltage detected by the voltage sensor, compare the temperature associated with the motor to the threshold temperature, and output a warning that the filter is full of debris when the temperature associated with the motor exceeds the threshold temperature.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the drawings.

DETAILED DESCRIPTION

Figure 1:
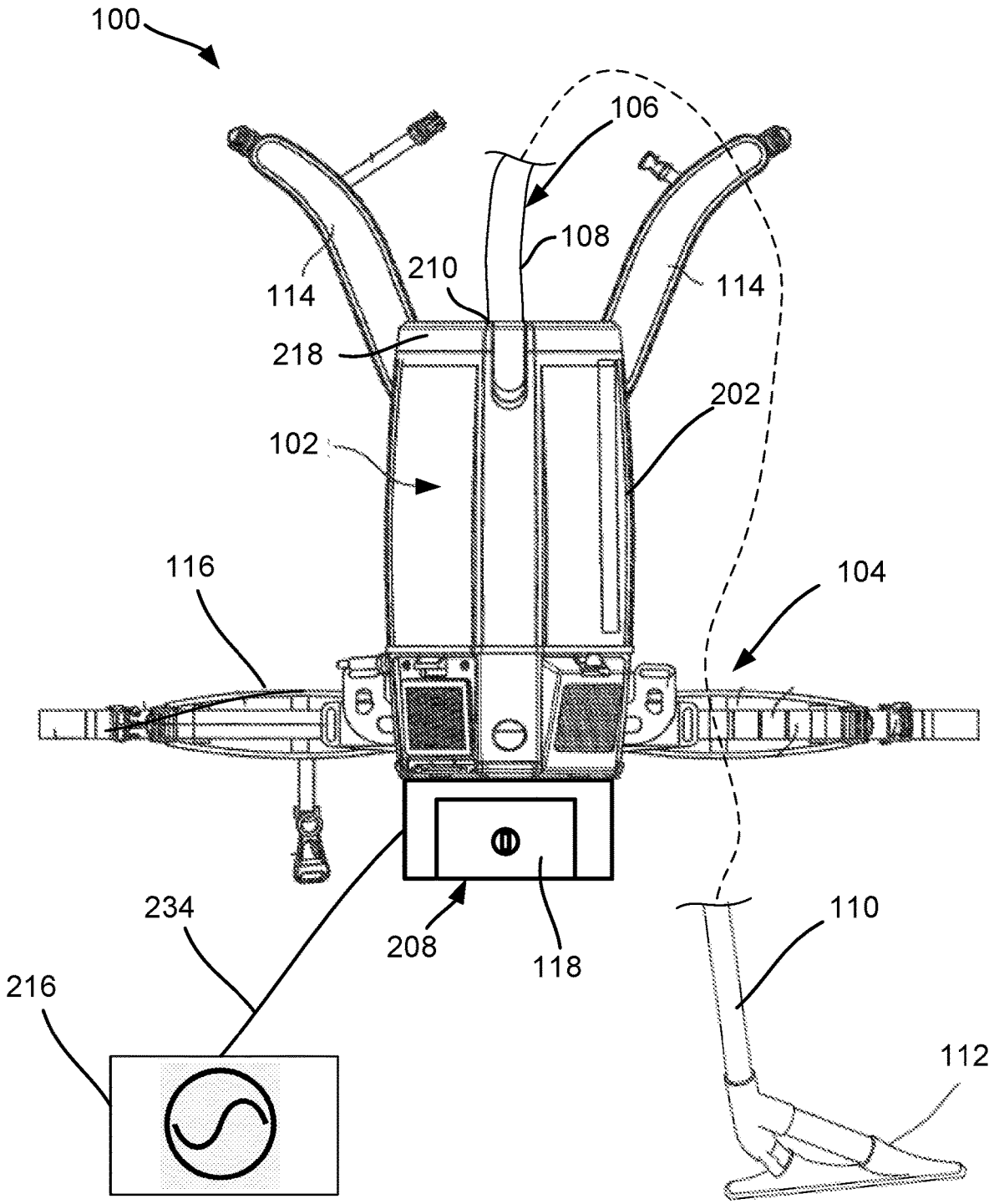
FIG. 1 is a perspective view of an example vacuum cleaner.

FIG. 1 is a perspective view of an example vacuum cleaner 100, shown in the form of a backpack vacuum cleaner. Although the vacuum cleaner 100 is shown and described herein with reference to a backpack mounted vacuum cleaner, vacuum cleaners consistent with this disclosure may be embodied in other types and in other combinations including, for example and without limitation, vehicular or automotive vacuum cleaners, wet/dry vacuum cleaners, canister vacuum cleaners, upright vacuum cleaners, stick vacuum cleaner, handheld vacuum cleaner, or any type of AC or DC vacuum cleaner. By way of example, aspects of the vacuum cleaners, such as the motor assemblies and control methods disclosed herein, may be implemented in automotive or transportation vacuum cleaners, such as those disclosed in U.S. Pat. Nos. 9,751,504; 10,328,907; and 10,099,659, the disclosures of which are hereby incorporated by reference in their entirety.

In the example embodiment, vacuum cleaner 100 includes a vacuum cleaner assembly 102 that is carried on a user's back via a harness or backpack assembly 104, and a vacuum conduit 106 connected to the vacuum cleaner assembly 102. The vacuum conduit 106 may generally include any suitable conduit for directing suction and/or forced air generated by the vacuum cleaner 100, including, for example and without limitation, vacuum hoses, vacuum wands or tubes, surface cleaning tools, and combinations thereof. In the illustrated embodiment, the vacuum conduit 106 includes a hose 108 extending from a top of the vacuum cleaner assembly 102, a vacuum cleaner wand 110 connected to the hose 108, and a vacuum cleaner floor tool 112 connected to a distal end of the wand 110.

The backpack assembly 104 is sized and shaped to be worn by a user of the vacuum cleaner 100 (e.g., on the user's back or shoulders) to facilitate carrying the vacuum cleaner 100 during use. In the illustrated embodiment, the backpack assembly 104 includes two shoulder straps 114 and a waist belt 116 for securing the backpack assembly 104 and vacuum cleaner 100 to the torso of a user. In other embodiments, the backpack assembly 104 may have any suitable configuration that enables the vacuum cleaner 100 to function as described herein.

Figure 2:
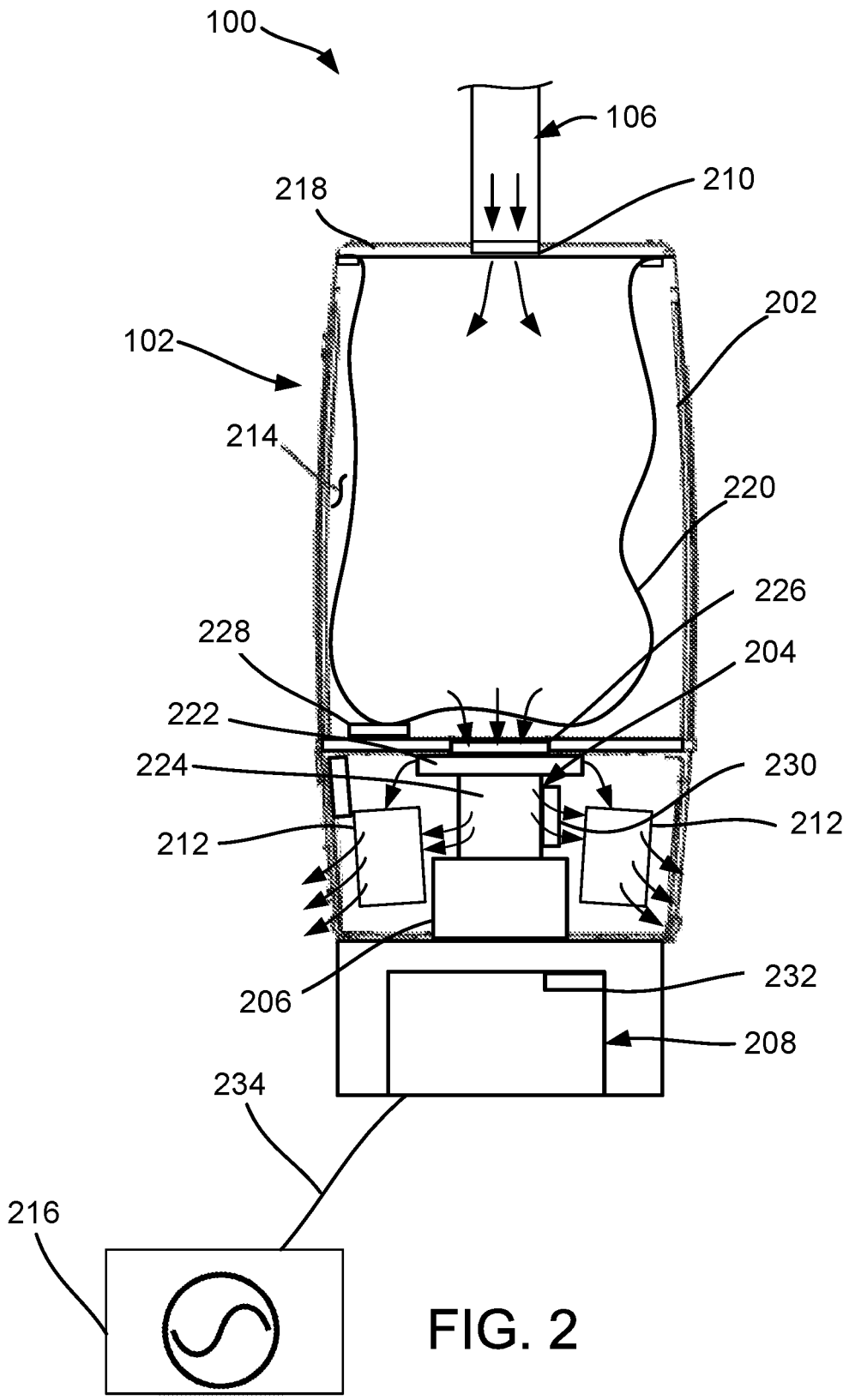
FIG. 2 is a side schematic view of the vacuum cleaner shown in FIG. 1.
Figure 3:
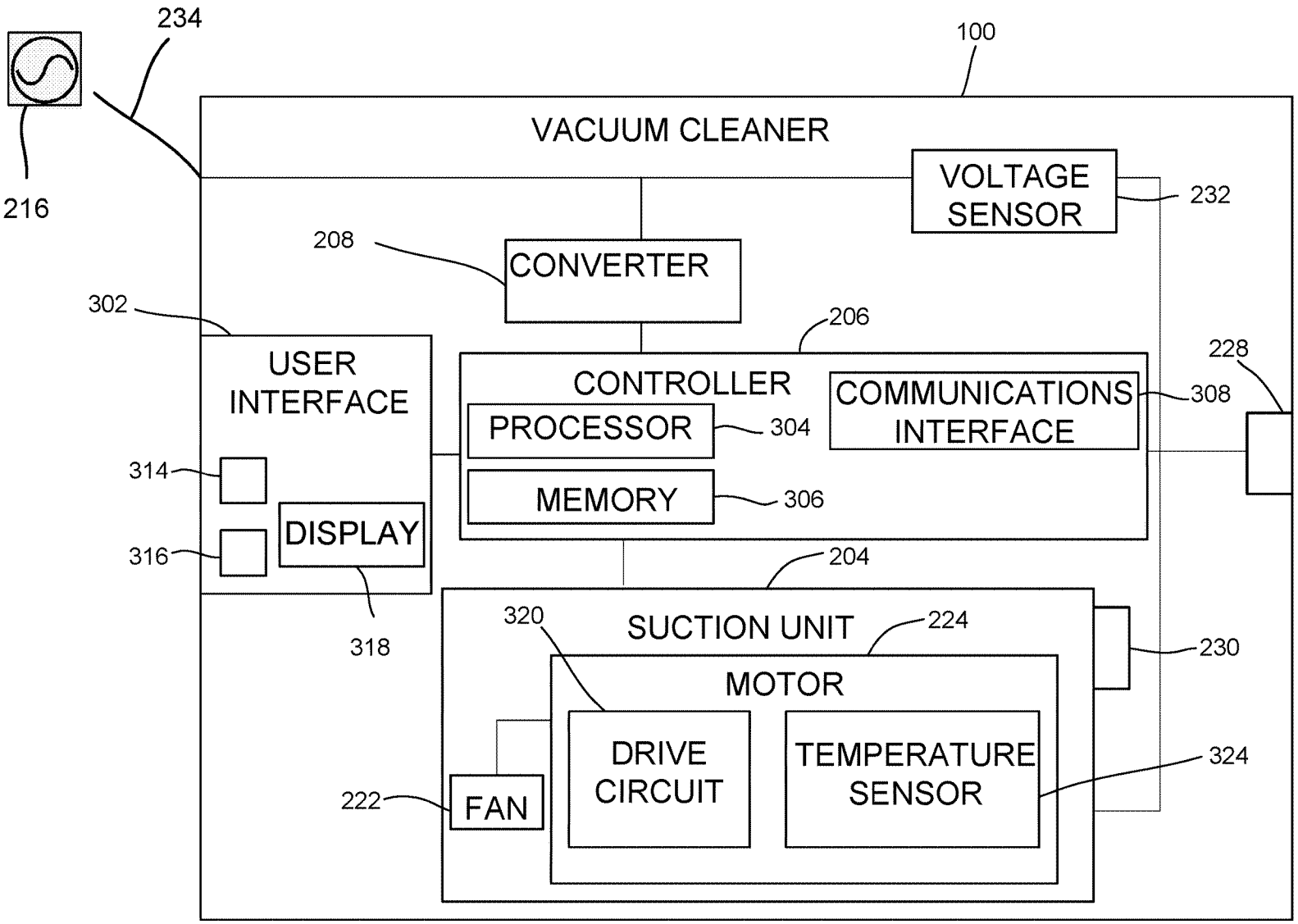
FIG. 3 is a block diagram of the vacuum cleaner shown in FIG. 1.

With additional reference to FIGS. 2 and 3, the vacuum cleaner assembly 102 includes a housing 202, a suction unit 204 enclosed within the housing 202, a controller 206, and a power converter 208. The components and connections shown in FIG. 3 are a functional example only. Other embodiments may include different components, more or fewer components, components connected to different components, and/or different polarity connections. Further, components may be located outside of the vacuum cleaner assembly 102, such as in the straps 114, the waist belt 115, in a switch box, or any other suitable location. Components may also be removably attached to the vacuum cleaner assembly 102, using a plug or other suitable connector.

The housing 202 defines an inlet 210, at least one exhaust or outlet 212, and a debris chamber 214 connected in fluid communication between the inlet 210 and the outlet 212. In the example embodiment, the inlet 210 is defined at a top of the housing 202, and the housing 202 includes two outlets 212 defined adjacent a bottom of the housing 202. In other embodiments, the inlet 210 and the outlet(s) 212 may be defined at any suitable portion of the vacuum cleaner 100 that enables the vacuum cleaner 100 to function as described herein. Further, the vacuum cleaner 100 may include more than or fewer than two outlets 212.

In the illustrated embodiment, the housing 202 includes an access door or lid 218 that provides access to the debris chamber 214, for example, to empty debris collected within the debris chamber 214. The inlet 210 is defined in the lid 218 in the example embodiment. Further, the example housing 202 is adapted to receive a filter 220 within the debris chamber 214 to filter out fine debris and small particles from the air flow through the housing 202. In the illustrated embodiment, the filter 220 is a bag filter, although the vacuum cleaner 100 may be operable with other types of filters, including, for example and without limitation, cartridge filters.

The suction unit 204 is operable to generate airflow (indicated by arrows in FIG. 2) through the housing 202 from the inlet 210 to the outlet 212 so as to draw debris into the debris chamber 214 through the inlet 210 by way of the vacuum conduit 106 (shown in FIG. 1). The suction unit 204 includes a fan or impeller 222 and a motor 224 operatively connected to the impeller 222 (collectively referred to herein as a "motor assembly") to drive the impeller 222 and generate airflow through the housing 202. The motor 224 may be an AC or DC motor. The motor assembly is connected to the housing 202 and positioned adjacent the debris chamber 214 such that the impeller 222 receives airflow through an impeller inlet 226 defined by the housing 202. In certain embodiments, the motor assembly may also be adapted to operate in a "reverse" mode in which the motor assembly generates airflow from the outlet 212 to the inlet 210, so as to enable the vacuum cleaner 100 to operate as a blower.

The controller 206 is generally configured to control one or more operations or processes of the vacuum cleaner 100, as described further herein. In some embodiments, for example, the controller 206 receives user input from a user interface 302 of vacuum cleaner 100, and controls one or more components of vacuum cleaner 100 in response to such user inputs. The user interface 302 includes a power switch 314, a speed selection switch 316, and a display 318. The power switch 314 is a single pole single throw (SPST) momentary switch operated by the user to turn the vacuum cleaner 100 on and off. Alternatively, the power switch 314 may be a maintained switch rather than a momentary switch. The speed selection switch 316 is a dual pole dual throw (DPDT) switch operable by the user to select an operation speed of the motor 224 of the vacuum cleaner 100. The power switch or speed switch may be any combination of SPST, DPST, momentary or maintained. The power switch or speed switch may be combined in the momentary switch to cycle through, example OFF, HI, LOW with every press. The display 318 is a visual display for displaying information about the vacuum cleaner 100 to the user. In the example embodiment, the display 318 is a light emitting diode (LED) but may be any other type of light. Alternatively, the display 318 may be a plurality of LEDs, a display screen (such as an LED panel, a liquid crystal display (LCD) panel, or the like), or any other display suitable for visually displaying information to the user of the vacuum cleaner 100. In some embodiments, the plurality of LEDs or other lights may include sequences of lighting such as blinking. Although display 318 is described as visual, the display 318 may include an audible output, such as a speaker or siren.

In some embodiments, the controller 206 controls the supply of power to the vacuum suction unit 204 based on user input received from the user interface 302. For example, the controller 206 operates the motor 224 in response to user input received from the power switch 314 and the speed selection switch 316. In other embodiments, switch 316 is a configured to directly connect/disconnect power from the motor 224.

The controller 206 may generally include any suitable computer and/or other processing unit, including any suitable combination of computers, processing units and/or the like that may be operated independently or in connection within one another. The controller 206 may include one or more processor(s) 304 and associated memory device(s) 306 containing instructions that cause the processor 304 (i.e., "configure the processor" or "program the processor") to perform a variety of computer-implemented functions (e.g., performing the calculations, determinations, and functions disclosed herein). As used herein, the term "processor" refers not only to integrated circuits, but also refers to a controller, a microcontroller (MCU), a microcomputer, a programmable logic controller (PLC), an application specific integrated circuit (ASIC), system on chip (SoC), field programmable gate array (FPGA), and other programmable circuits. Additionally, the memory device(s) 306 of controller 206 may generally be or include memory element(s) including, but not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Memory device(s) 306 may include memory elements coupled to the controller through a universal serial bus (USB) interface. Such memory device(s) 306 may generally be configured to store suitable computer-readable instructions that, when implemented by the processor(s), configure or cause the controller 206 to perform various functions described herein including, but not limited to, controlling vacuum cleaner 100, controlling operation of vacuum suction unit 204, receiving inputs from user interface 302, providing output to an operator via user interface 302, and/or various other suitable computer-implemented functions.

The controller 206 includes a communications interface 308. Communications interface 308 allows the vacuum cleaner 100 (and more particularly, the controller 206) to communicate with remote devices and systems as part of a wired or wireless communication network. Wireless network interfaces may include, but are not limited to, a radio frequency (RF) transceiver, a Bluetooth® adapter, a Wi-Fi transceiver, a ZigBee® transceiver, a near field communication (NFC) transceiver, an infrared (IR) transceiver, and/or any other device and communication protocol for wireless communication. (Bluetooth is a registered trademark of Bluetooth Special Interest Group of Kirkland, Wash.; ZigBee is a registered trademark of the ZigBee Alliance of San Ramon, Calif.) For all wireless protocols, the band may include the common bands (315 MHz, 2.4 GHz, 5 GHz), or a proprietary band. Wired network interfaces may use any suitable wired communication protocol for direct communication including, without limitation, USB, RS232, I2C, SPI, UART, CAN bus, analog, mixed signal, and proprietary I/O protocols. Moreover, in some embodiments, the wired network interfaces include a wired network adapter allowing the computing device to be coupled to a network, such as the Internet, a local area network (LAN), a wide area network (WAN), a mesh network, and/or any other network to communicate with remote devices and systems via the network. Controller 206 transmits and receives communications over the communication network using messages formatted according to an appropriate network communication protocol. In some embodiments, the network communication protocol is an Ethernet communication protocol or an Institute of Electrical and Electronics Engineers (IEEE) 802.11 based communication protocol. In some embodiments, the communications interface 308 includes wired and wireless communications interfaces. In some embodiments, the communications interface 308 includes a wired communication interface for communicative connection to a communication interface in an automobile. Other embodiments do not include communications interface 308.

The communications interface 308 may be used, for example, for communicating diagnostics information, providing the serial number of the vacuum cleaner 100, providing maintenance performed information, providing firmware version information, receiving firmware updates and reprogramming, and providing motor 224 operation/fault status information to a diagnostic/monitoring device, or the like.

The controller 206 and/or components of controller 206 may be integrated or incorporated within other components of the vacuum cleaner 100. In some embodiments, for example, controller 206 may be incorporated within the vacuum suction unit 204 or the motor assembly.

In the example embodiment, the power source for the vacuum cleaner 100 is an AC power source with power cord 234 coming from mains AC electricity via an AC wall outlet 216. The high voltage AC power is directly sent to the motor 224 to supply power to operate the motor 224 and/or to power other operational components of the vacuum cleaner. The high voltage AC power is also sent to the power converter 208 to convert the high power AC voltage to low voltage DC power, which is used to power the controller 206. In other embodiments, the power source for the vacuum cleaner 100 is a DC power source, such as a rechargeable battery.

The illustrated vacuum cleaner 100 also includes a plurality of sensors 228, 230, 232 connected to the controller 206. The sensors 228, 230, 232 may provide feedback to the controller 206 regarding operation of the vacuum cleaner 100, and the controller 206 may control the vacuum cleaner 100 based on feedback received from the sensors 228, 230, 232. Sensors 228, 230, and 232 may include, for example and without limitation, proximity sensors, pressure sensors, temperature sensors, voltage sensors, and active or passive current sensors. As shown in FIG. 3, sensor 232 is a voltage sensor that senses the input line voltage going directly to the motor 224. The voltage sensor measures the AC line voltage and sends a variable low voltage DC signal to the controller 206 indicating the measured AC line voltage.

The vacuum cleaner 100 includes a drive circuit 320 in the motor 224 for powering the suction unit 204. The drive circuit 320 controls the motor 224 in response to signals received from the controller 206. A temperature sensor 324 is positioned in the motor 224. Specifically, the sensor 324 is positioned on or near the windings of the motor 224 to monitor the temperature of the motor windings. Although the temperature sensor 324 is shown as part of the motor 224, the temperature sensor 324 may be placed outside the motor housing of the motor 224, in the airflow of the fan 222, or as part of the suction unit 204. In some embodiments, the temperature sensor 324 includes more than one temperature sensor 324, each of which is positioned at different positions around or inside the suction unit 204, motor 224, and fan 222. In the example embodiment, the temperature sensor 324 is a thermistor thermally coupled to the motor 324 by a thermally conductive room-temperature-vulcanized (RTV) component or a thermally conductive adhesive. Alternatively, the temperature sensor 324 may be a resistance temperature detector (RTD), a thermocouple, or any other sensor suitable for measuring temperature. Although illustrated as part of motor 224, the drive circuit 320 may be incorporated into the controller 206 or as a separate component.

To operate the vacuum cleaner 100, the user depresses the power switch 314. In the example embodiment, the power switch 314 is a momentary switch, which sends a signal to the controller 206 only when the user depresses the power switch 314. Generally, upon receiving the signal from the power switch 314, the controller toggles the on/off state of the vacuum cleaner 100. That is, if the vacuum cleaner 100 is off, depressing the power switch 314 provides a signal that the controller 206 interprets as a request to turn on the vacuum cleaner 100. When the vacuum cleaner 100 is on, depressing the power switch 314 provides a signal that the controller 206 interprets as a request to turn off the vacuum cleaner 100. In other embodiments, the power switch 314 is a switch that directly supplies or interrupts AC power to the motor 224.

The controller 206 is also configured to prevent operation of the vacuum cleaner 100 when the filter 220 is not installed in the vacuum cleaner 100. A sensor (e.g., sensor 228) is positioned to detect when the filter 220 is installed and to provide a signal to the controller 206 when the filter 220 is not installed. Alternatively, the sensor may provide a signal when the filter 220 is installed and not provide a signal when the filter is absent. In an example embodiment, the sensor is a switch connected in series to a sensing pin of the controller 206. When the filter 220 is installed, the filter 220 depresses the switch, closing the circuit connection to the sensing pin, and thereby provides a signal to the controller that the filter 220 is installed. When the filter 220 is absent (or improperly installed), the switch is not depressed, the circuit is open, and no signal is provided to the sensing pin of the controller 206. Alternatively, the switch may be positioned to detect whether a cover (or door) of debris chamber 214 (in which the filter 220 is located) is open or closed. The controller 206 is configured to prevent operation of the motor 224 when the cover is open and allow operation when the cover is closed. By preventing operation of the vacuum cleaner 100 when the filter 220 is not installed or the cover is open, debris may be prevented from contaminating the motor and/or striking the impeller 222 or other elements of the suction unit 204.

The controller 206 provides thermal protection for the motor 224 and drive circuit 320, and communicates thermal protection related information to the user of the vacuum cleaner 100. The controller 206 monitors the temperature of the motor 224 and associated drive circuit 320 using the temperature sensor 324. Generally, when the detected temperature exceeds a threshold temperature, the controller 206 warns the user of a filter full of debris condition. A filter full condition restricts airflow through the suction unit 204, causing the motor 224 to heat up, and raising the detected temperature to exceed the threshold temperature. When the detected temperature exceeds the threshold temperature, the filter bag for debris is likely full. Specifically, a warning that the filter 220 is full of debris when the temperature associated with the motor 224 exceeds the threshold temperature is shown to the user. The temperature increase is affected by the line voltage directly applied to the motor from the AC wall outlet 216. Regardless of the current debris fullness of filter 220 bag, the motor 224 gets hotter at higher voltages than lower voltages. Even if a filter full condition is reached and the threshold temperature is exceeded, the motor 224 temperature will rise as the voltage is increased.

In some embodiments, the controller 206 provides a separate warning indicating that airflow is obstructed other than by a full debris bag, such as when a piece of debris blocks the inlet 210. Such an obstruction will cause the temperature associated with the motor 224 to change relatively rapidly (compared to filling up the filter bag 220). The controller 206 may detect the obstruction based on how quickly the temperature changes over a defined period of time.

Figure 4:
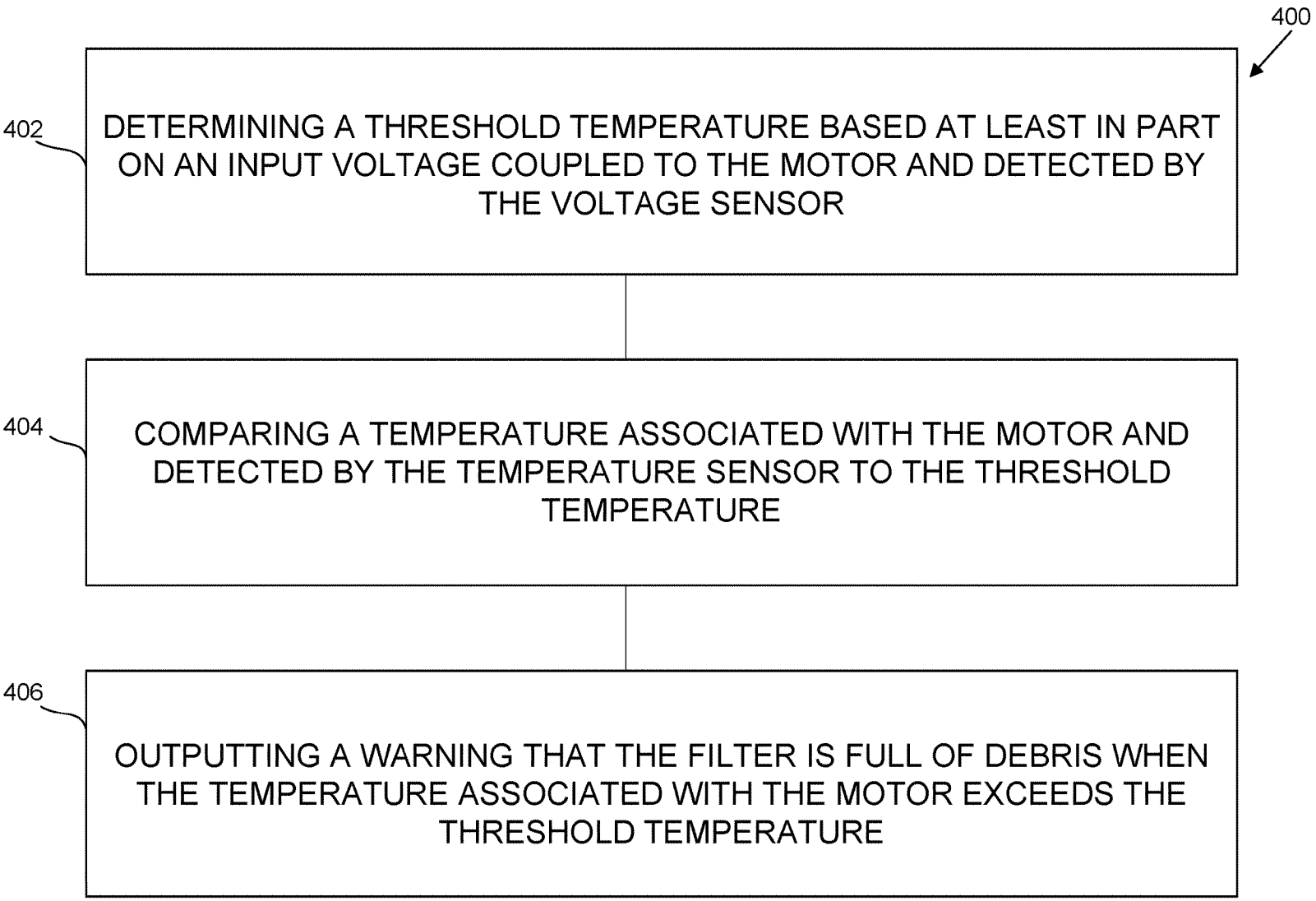
FIG. 4 is a flow diagram of an example method of operation for the vacuum cleaner shown in FIG. 1 when the filter is full of debris.

FIG. 4 is a flow diagram of an example method 400 of operation for use with the vacuum cleaner 100 to communicate when the filter 220 is full of debris. The method 400 may be used with other vacuum cleaners, and the vacuum cleaner may use other methods for providing warnings and communication. The method 400 may also be used with vacuum cleaners using a DC voltage source, with the monitored input voltages being DC, rather than AC voltages.

At 402, the controller 206 determines a threshold temperature based at least in part on an input voltage coupled to the motor 224. In the example embodiment, the input voltage is the line voltage detected by the voltage sensor 232, before being communicated to the controller 206. In the example embodiment, determining the threshold temperature is done by retrieving the threshold temperature associated with the detected input voltage from a lookup table in a memory 306 of the controller 206. The lookup table has a plurality of input voltages mapped to a plurality of threshold temperatures as thermocouple pairs. The lookup table may be pre-loaded by a manufacturer or programmed for a plurality of types of vacuum cleaners.

Other embodiments for determining the threshold temperature may include calculating the threshold temperature from a default threshold temperature using the detected input voltage. The default threshold temperature may be pre-programmed by a manufacturer based upon a specific input voltage (e.g., 110V AC) for a specific vacuum cleaner. For example, calculating the threshold temperature from the default threshold temperature includes scaling the default threshold temperature based on the detected input voltage. The default threshold may be multiplied by a scaling factor to calculate the threshold temperature. The scaling factor is derived from an equation or retrieved from a look-up table of a plurality of scaling factors for a plurality of vacuums and are stored in memory 306. Alternatively, the scaling factor may be determined based directly on the measured temperature from temperature sensor 324. Alternatively, the scaling factor may be determined based on how much the scaling factor is greater than or less than a default input voltage. For example, the default input voltage may be 110V AC and the scaling factor is 1.0, or unscaled. The scaling factor increases by 0.1 for every additional 20V over 110V input voltage. If the input voltage was 130V AC, than the scaling factor increases to 1.1. Alternatively, the temperature threshold scaling may cover ranges of voltages. For example, if the input voltage is above or beneath the default input voltage within 2V, then the scaling is 1.0, or unscaled. If the input voltage is above or beneath the default input voltage within 4V, the scaling is raised by 0.1 to 1.1. This continues as the range increases by increments of 2V. Although specific scaling and ranges are described here, any scaling for any range may be used. Alternatively, the scaling may be a temperature addition to or subtraction from the default temperature threshold. Based on a specific voltage, the default temperature threshold is raised or lowered by a specific amount reflected by the scaling. Alternatively, the scaling may be based on difference between the input voltage and the default voltage. For example, for every 10V above or below the default voltage, 5° C. degrees is added or subtracted to the default temperature threshold. Alternatively, the threshold temperature may be continuously adjusted based on the current values associated with the input voltage while the vacuum is running. Alternatively, the input voltage used to find the threshold temperature may be a running average of the voltages over a period of time that the vacuum is operating.

In step 404 the temperature associated with the motor and detected by the temperature sensor is compared to the threshold temperature. At step 406 a warning that the filter is full of debris is output when the temperature associated with the motor exceeds the threshold temperature. In some embodiments, outputting the warning that the filter is full of debris includes outputting a visual warning, such as by lighting a warning light on the vacuum cleaner. In some embodiments, outputting the warning includes outputting an audible warning such as by changing the pitch of the running motor 224 in a pulse pattern to output an audible warning to the user. However produced, the warning alerts the user to the condition, and the user may take action (such as turning off the vacuum cleaner 100, clearing an airway obstruction, cleaning or replacing the filter, or the like).

In some embodiments, warnings to the user about a filter full event may additionally or alternatively be provided to the user through the user interface 302 of the vacuum cleaner 100. For example, a filter full warning may be presented to the user via the user interface 302 when the controller 206 detects the temperature exceeds the temperature threshold at 406. The warning may be presented using the display 318. When the display 318 is an LED or an array of LEDs, the warning may be present by a particular pattern of blinking, lighting a particular LED associated with a temperature warning, lighting a particular color LED, or lighting a particular pattern of LEDs. If the display 318 is an LCD panel, an LED panel, or other similar display panel, the warning may be displayed as a text warning readable by the user or as an image (such as of a bag full of debris). In some embodiments, the user interface 302 includes an audio output device (not shown), such as a piezoelectric device, to produce human audible sounds to convey information to the user. In such embodiments, the audio output device may output a unique pattern of sound or a unique tone to indicate that the filter is full of debris (e.g., when the temperature associated with the motor exceeds the threshold temperature.). Alternatively, the audio output device may output a spoken warning to the user (using a recorded announcement or a text-to-speech announcement). Additionally, or alternatively, the user interface 302 may include a vibration motor (not shown) to provide information to a user. Similar to the audio output of the audio output device, the vibration motor may output a unique pattern of vibration to indicate that the filter is full of debris (e.g., when the temperature associated with the motor exceeds the threshold temperature.).

Example embodiments of vacuum cleaning systems are described above in detail. The vacuum cleaning systems are not limited to the specific embodiments described herein, but rather, components of the vacuum cleaning systems may be used independently and separately from other components described herein. For example, the vacuum cleaner motor assemblies and associated features described herein may be used with a variety of vacuum cleaning systems, including and without limitation, vehicular or automotive vacuum cleaning systems, wet/dry vacuum cleaners, canister vacuum cleaners, stick vacuum cleaners, handheld vacuum cleaners, and upright vacuum cleaners.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawings shall be interpreted as illustrative and not in a limiting sense.

The invention claimed is:

1. A vacuum cleaner comprising:

a housing;

a debris chamber defined within the housing;

a filter disposed within the debris chamber;

a motor assembly connected to the housing and operable to generate airflow through the debris chamber and the filter, the motor assembly including a motor and an impeller;

a voltage sensor positioned to detect an input voltage applied to the motor;

a temperature sensor positioned to detect a temperature associated with the motor; and a controller communicatively coupled to the voltage sensor, the temperature sensor, and the motor, the controller including a processor and a memory, the memory including instructions that program the processor to:

determine a threshold temperature based at least in part on the input voltage detected by the voltage sensor;

compare the temperature associated with the motor to the threshold temperature; and output a warning that the filter is full of debris when the temperature associated with the motor exceeds the threshold temperature.

2. The vacuum cleaner of claim 1, wherein the instructions program the processor to determine the threshold temperature by retrieving the threshold temperature associated with the detected input voltage from a lookup table in the memory.

3. The vacuum cleaner of claim 1, wherein the instructions program the processor to determine the threshold temperature by calculating the threshold temperature from a default threshold temperature using the detected input voltage.

4. The vacuum cleaner of claim 3, wherein the instructions program the processor to calculate the threshold temperature from a default threshold temperature by scaling the default threshold temperature based on the detected input voltage.

5. The vacuum cleaner of claim 4, wherein the instructions program the processor to scale the default threshold temperature by multiplying the default threshold temperature by a scaling factor determined based on the detected input voltage.

6. The vacuum cleaner of claim 4, wherein the instructions program the processor to scale the default threshold temperature by summing the default threshold temperature and a scaling temperature determined based on the detected input voltage.

7. The vacuum cleaner of claim 1 further comprising a warning light coupled to the controller, wherein the instructions program the processor to output the warning that the filter is full of debris by lighting the warning light.

8. A method of operating a vacuum cleaner including a debris chamber, a filter disposed within the debris chamber, a motor driving an impeller to generate airflow through the debris chamber and the filter, a voltage sensor, a temperature sensor, and a controller communicatively coupled to the voltage sensor, the temperature sensor, and the motor, the method comprising:

determining a threshold temperature based at least in part on an input voltage coupled to the motor and detected by the voltage sensor;

comparing a temperature associated with the motor and detected by the temperature sensor to the threshold temperature; and outputting a warning that the filter is full of debris when the temperature associated with the motor exceeds the threshold temperature.

9. The method of claim 8, wherein determining the threshold temperature comprises retrieving the threshold temperature associated with the detected input voltage from a lookup table in a memory of the controller.

10. The method of claim 8, wherein determining the threshold temperature comprises calculating the threshold temperature from a default threshold temperature using the detected input voltage.

11. The method of claim 10, wherein calculating the threshold temperature from the default threshold temperature comprises scaling the default threshold temperature based on the detected input voltage.

12. The method of claim 10, wherein outputting the warning that the filter is full of debris comprises lighting a warning light on the vacuum cleaner.

13. A controller for a vacuum cleaner including a housing, a debris chamber defined within the housing, a filter disposed within the debris chamber, a motor driving an impeller to generate airflow through the debris chamber and the filter, a voltage sensor positioned to detect an input voltage applied to the motor, and a temperature sensor positioned to detect a temperature associated with the motor, the controller comprising:

a processor to be communicatively coupled to the motor, the voltage sensor, and the temperature sensor; and a memory, the memory including instructions that program the processor to:

determine a threshold temperature based at least in part on the input voltage detected by the voltage sensor;

compare the temperature associated with the motor to the threshold temperature; and output a warning that the filter is full of debris when the temperature associated with the motor exceeds the threshold temperature.

14. The controller of claim 13, wherein the instructions program the processor to determine the threshold temperature by retrieving the threshold temperature associated with the detected input voltage from a lookup table in the memory.

15. The controller of claim 13, wherein the instructions program the processor to determine the threshold temperature by calculating the threshold temperature from a default threshold temperature using the detected input voltage.

16. The controller of claim 15, wherein the instructions program the processor to calculate the threshold temperature from a default threshold temperature by scaling the default threshold temperature based on the detected input voltage.

17. The controller of claim 16, wherein the instructions program the processor to scale the default threshold temperature by multiplying the default threshold temperature by a scaling factor determined based on the detected input voltage.

18. The controller of claim 16, wherein the instructions program the processor to scale the default threshold temperature by summing the default threshold temperature and a scaling temperature determined based on the detected input voltage.

19. The controller of claim 13, wherein the instructions program the processor to output the warning that the filter is full of debris by lighting a warning light on the vacuum cleaner.

20. The controller of claim 13, wherein the instructions program the processor to output the warning that the filter is full of debris by generating an audible alert.

* * * * *